US011138916B2

(12) United States Patent
Wang

(10) Patent No.: US 11,138,916 B2
(45) Date of Patent: Oct. 5, 2021

(54) DRIVE CIRCUIT, DRIVE METHOD AND DISPLAY APPARATUS

(71) Applicant: HKC CORPORATION LIMITED, Shenzhen (CN)

(72) Inventor: Mingliang Wang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/982,546

(22) PCT Filed: Nov. 23, 2018

(86) PCT No.: PCT/CN2018/117091

§ 371 (c)(1),
(2) Date: Sep. 19, 2020

(87) PCT Pub. No.: WO2020/093467

PCT Pub. Date: May 14, 2020

(65) Prior Publication Data

US 2021/0005126 A1 Jan. 7, 2021

(30) Foreign Application Priority Data

Nov. 9, 2018 (CN) ..... 201811331793.X

(51) Int. Cl.
*G09G 3/20* (2006.01)

(52) U.S. Cl.
CPC ..... *G09G 3/20* (2013.01); *G09G 2300/0408* (2013.01); *G09G 2310/0291* (2013.01); *G09G 2320/02* (2013.01)

(58) Field of Classification Search
None
See application file for complete search history.

(56) References Cited

U.S. PATENT DOCUMENTS 9,300,624 B2 * 3/2016 Kowalski ..... G06F 16/2365
2004/0041778 A1 * 3/2004 Hiraki ..... G09G 3/3688 345/100

(Continued)

FOREIGN PATENT DOCUMENTS

CN 1982957 A 6/2007
CN 101398550 A 4/2009

(Continued)

OTHER PUBLICATIONS

Wenfei Li, the ISA written comments, dated Jul. 2019, CN.
Wenfei Li, the International Search Report, dated Jul. 2019, CN.

*Primary Examiner* — Aneeta Yodichkas

(57) ABSTRACT

This application discloses a drive circuit, a drive method and a display apparatus. The drive circuit includes: an initiator configured to output a common voltage, a compensator coupled to the initiator, and a controller; the initiator includes an initial memory configured to store an initial value of the common voltage, and an operational circuit configured to convert the initial value of the common voltage into an output common voltage to output; and the controller collects the initial value of the common voltage of the initiator and a value of the output common voltage, and compares the initial value of the common voltage and the value of the output common voltage, thereby deciding whether to control the compensator to compensate the value of the common voltage or not.

17 Claims, 4 Drawing Sheets

(56) References Cited

U.S. PATENT DOCUMENTS

| | | | | |
|---|---|---|---|---|
| 2007/0063957 | A1 | 3/2007 | Awakura et al. | |
| 2008/0266222 | A1* | 10/2008 | Feng | G09G 3/3655 345/87 |
| 2012/0242641 | A1* | 9/2012 | Lee | G09G 3/3655 345/212 |
| 2018/0033384 | A1* | 2/2018 | Kim | G09G 3/3614 |
| 2018/0082650 | A1* | 3/2018 | Li | G09G 3/3614 |
| 2019/0088228 | A1* | 3/2019 | Lee | G09G 3/3688 |
| 2021/0110779 | A1* | 4/2021 | Wang | G09G 3/3648 |

FOREIGN PATENT DOCUMENTS

| | | | |
|---|---|---|---|
| CN | 102842280 | A | 12/2012 |
| CN | 103413533 | A | 11/2013 |
| CN | 105469767 | A | 4/2016 |
| CN | 106652968 | A | 5/2017 |
| CN | 108269544 | A | 7/2018 |
| CN | 108269545 | A | 7/2018 |

* cited by examiner

DRIVE CIRCUIT, DRIVE METHOD AND DISPLAY APPARATUS

CROSS REFERENCE OF RELATED APPLICATIONS

This application claims priority to the Chinese Patent Application No. CN201811331793.X, filed with the Chinese Patent Office on Nov. 9, 2018, and entitled "DISPLAY PANEL, DISPLAY APPARATUS AND MANUFACTURING METHOD", which is incorporated herein by reference in its entirety.

TECHNICAL FIELD

This application relates to the technical field of display, and in particular to a drive circuit, a drive method and a display apparatus.

BACKGROUND

The description herein provides only background information related to this application, but does not necessarily constitute the existing technology.

Along with the development and progress of science and technology, a flat-panel display has become a mainstream display product and is widely applied because of hot points such as a thin body, power saving and low radiation. The flat-panel displays include a Thin Film Transistor-Liquid Crystal Display (TFT-LCD) and an Organic Light-Emitting Diode (OLED) display, etc. Among them, the TFT-LCD refracts light rays of a backlight module by controlling rotation directions of liquid crystal molecules to generate a picture and thus has numerous advantages such as a thin body, power saving and no radiation. However, the OLED display is made of an OLED and has many advantages such as self-illumination, short response time, high definition and contrast ratio, and capability of implementing flexible display and large-area full-color display.

Control processes of most display panels on a market are relatively simple. However, there is an impedance inside a control circuit board, resulting in that a display picture is affected and the display effect of the display panel cannot be guaranteed.

SUMMARY

This application provides a drive circuit, a drive method and a display apparatus to actively compensate a deviation of a common voltage and guarantee the display effect.

To achieve the above objective, this application provides a drive circuit, which includes: an initiator, configured to output a common voltage; a compensator, coupled to the initiator; and a controller; the initiator includes: an initial memory, configured to store an initial value of the common voltage; and an operational circuit, configured to convert the initial value of the common voltage into an output common voltage to output; and the controller collects the initial value of the common voltage of the initiator and a value of the output common voltage, and compares the initial value of the common voltage and the value of the output common voltage, thereby deciding whether to control the compensator to compensate the value of the common voltage or not.

This application further discloses a drive circuit, which includes:

an initial memory, configured to store an initial value of a common voltage as well as a first signal code corresponding to the initial value of the common voltage;

a first switch, connected with the initial memory in a control manner, and configured to control, when a difference between the initial value of the common voltage and a value of an output common voltage is smaller than a preset threshold value, the initiator to work normally;

a digital-analog converter, configured to convert the first signal code transmitted from the initial memory into an analog voltage;

an output current amplifier, where an input end of the output current amplifier is coupled to an output end of the digital-analog converter and an output end of the output current amplifier outputs the common voltage;

a compensation memory, configured to store a compensating signal code;

a second switch, connected with the compensation memory in a control manner, and configured to control, when the difference between the initial value of the common voltage and the value of the output common voltage is greater than or equal to the preset threshold value, the compensation memory to work to compensate the value of the common voltage;

serial N resistors, where the resistors are serially connected between a reference voltage and a low level to form N−1 partial voltages;

an encoder, configured to encode a common voltage after voltage division;

N−1 analog-digital conversion triodes, where first input ends of the N−1 analog-digital conversion triodes are respectively connected to a plurality of the partial voltages, second input ends of the N−1 analog-digital conversion triodes all are connected to the output common voltage of the initiator, and output ends of the N−1 analog-digital conversion triodes are connected to the encoder; and the encoder encodes the output common voltage of the initiator into a second signal code and transmits the second signal code to a master controller;

a decoder, coupled to an output end of an Analog-Digital Converter (ADC), and configured to decode the second signal code transmitted from the ADC;

a microcontroller, coupled to the decoder, and configured to perform operation on a decoded second signal code and the first signal code; and a controller, coupled to the microcontroller, and configured to decide, according to a comparison result of the microcontroller, whether to control the compensator to compensate the value of the common voltage or not; and the drive circuit further includes a control circuit board; and the initial memory, the first switch, the digital-analog converter, the output current amplifier, the compensation memory, the second switch, the serial N resistors, the encoder, the N−1 analog-digital conversion triodes, the decoder, the microcontroller and the controller all are integrated in the control circuit board.

This application further discloses a drive method, which is adapted to a drive circuit; the drive circuit includes an initiator and a compensator, and the drive method includes the following steps:

acquiring an output common voltage signal of an initiator;

acquiring an initial value of a common voltage stored in the initiator; and comparing the initial value of the common voltage and a value of an output common voltage, thereby deciding whether to control the compensator to compensate the value of the common voltage or not.

This application further discloses a display apparatus, which includes a display panel; the display panel includes: a first substrate; a second substrate, disposed opposite to the first substrate; an array layer, formed on the first substrate; a common electrode, formed on the second substrate; and the above-mentioned drive circuit.

Along with the higher resolution and the larger size of a liquid crystal panel, a current load removal of the common electrode gets bigger. Since there is an impedance inside the control circuit board, while a current is increased, the common voltage is reduced a lot and the common voltage is deviated in different degrees, thereby affecting the display effect. Meanwhile, as the common voltage is also affected by the array layer and the array layer is configured to transmit data of a display picture, the common voltage is also deviated in different degrees along with different display pictures. The compensator is increased and is coupled to the initiator. By detecting an actual output common voltage, after a deviation of the common voltage of the actual output voltage is beyond a set standard and when the common voltage of the drive circuit is increasingly reduced, the compensating signal code inside the compensation memory is enabled to compensate the deviation of the common voltage, and thus, the correction of the common voltage is implemented, and the display effect is guaranteed. Therefore, the design is simple and easy to operate.

BRIEF DESCRIPTION OF DRAWINGS

The drawings are included to provide further understanding of embodiments of this application, which constitute a part of the specification and illustrate the embodiments of this application, and describe the principles of this application together with the text description. Apparently, the accompanying drawings in the following description show merely some embodiments of this application, and a person of ordinary skill in the art may still derive other accompanying drawings from these accompanying drawings without creative efforts. In the accompanying drawings.

DETAILED DESCRIPTION

Figure 1:
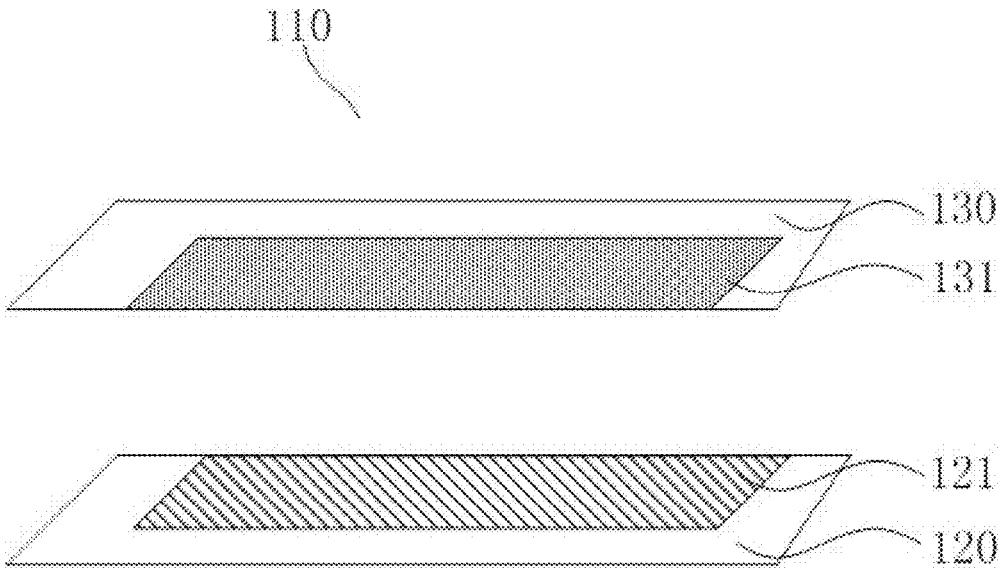
FIG. 1 is a structural schematic diagram of a display panel according to an embodiment of this application.
Figure 2:
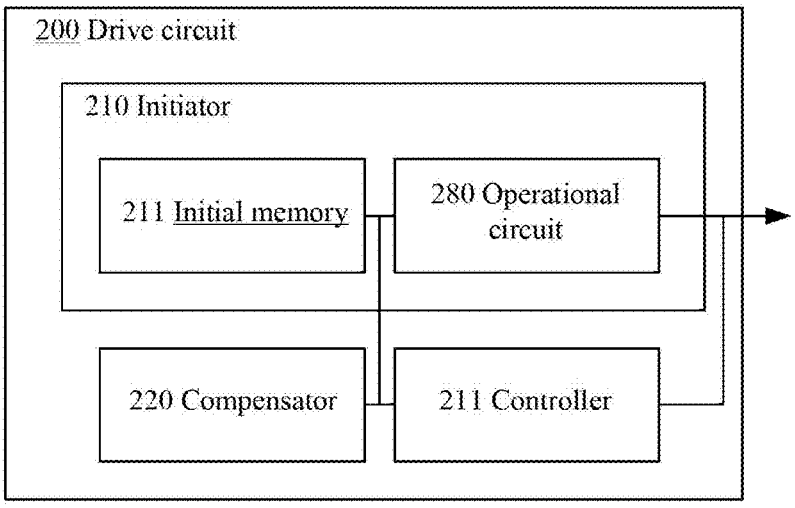
FIG. 2 is a schematic diagram of a drive circuit according to an embodiment of this application.

The specific structure and function details disclosed herein are merely representative, and are intended to describe exemplary embodiments of this application. However, this application can be specifically embodied in many alternative forms, and should not be interpreted to be limited to the embodiments described herein.

In the description of this application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of this application and simplifying the description only, rather than indicating or implying that the indicated device or element must have a particular orientation or be constructed and operated in a particular orientation. Therefore, these terms should not be understood as a limitation to this application. In addition, the terms such as "first" and "second" are merely for a descriptive purpose, and cannot be understood as indicating or implying relative importance, or implicitly indicating the number of the indicated technical features. Hence, the features defined by "first" and "second" can explicitly or implicitly include one or more features. In the description of this application, "a plurality of" means two or more, unless otherwise stated. In addition, the term "include" and any variations thereof are intended to cover a non-exclusive inclusion.

In the description of this application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or coupled; or directly connected or indirectly connected through an intermediate medium, or in an internal communication between two elements. The specific meanings about the foregoing terms in this application may be understood by those skilled in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

This application will be further described below in combination with the accompanying drawings and optional embodiments.

As shown in FIG. 1 to FIG. 4, an embodiment of this application discloses a drive circuit 200; the drive circuit 200 includes an initiator 210 configured to output a common voltage, a compensator 220 coupled to the initiator 210, and a controller 230; the initiator 210 includes an initial memory 211 configured to store an initial value of the common voltage, and an operational circuit 280 configured to convert the initial value of the common voltage into an output common voltage to output; and the controller 230 collects the initial value of the common voltage of the initiator 210 and a value of the output common voltage, and compares the initial value of the common voltage and the value of the output common voltage, thereby deciding whether to control the compensator 220 to compensate the value of the common voltage or not.

In this solution, as shown in FIG. 1, a liquid crystal panel is divided into a lower array layer (array) and an upper common electrode (common). A common voltage of the upper common voltage is generally referred to as a VCOM. Along with the higher resolution and the larger size of the liquid crystal panel, a current load removal of the common electrode 131 gets bigger. Since there is an impedance inside the drive circuit 200, while a current is increased, the common voltage is reduced a lot and the common voltage is deviated in different degrees, thereby affecting the display effect. Meanwhile, as the common voltage is also affected by the array layer 121 and the array layer 121 is configured to transmit data of a display picture, the common voltage is also deviated in different degrees along with different display pictures. The controller 230 is increased on the drive circuit 200; the controller 230 collects the initial value of the common voltage of the initiator 210 and the value of the output common voltage, and compares the initial value of the common voltage and the value of the output common voltage, thereby deciding whether to control the compensator 220 to compensate the value of the common voltage or not, i.e., a deviation of the common voltage; and thus, the correction of the common voltage is implemented, and the display effect is guaranteed.

In this embodiment, optionally, the controller 230 includes a first switch 240 and a second switch 250; the first switch 240 is connected with the initiator 210 in a control manner, and is configured to control, when a difference between the initial value of the common voltage and the value of the output common voltage is smaller than a preset threshold value, the initiator 210 to work normally; and the second switch 250 is connected with the compensator 220 in a control manner, and is configured to control, when the difference between the initial value of the common voltage and the value of the output common voltage is greater than or equal to the preset threshold value, the compensator 220 to work to compensate the value of the common voltage.

In this solution, the preset threshold value is taken as a reference standard. The preset threshold value is obtained with the consideration to the display effect of the display panel 110 as well as different sizes and resolutions of the panel, and is set by an inventor in the art according to a specific condition. Any beyond the preset threshold value is considered as that the common voltage is beyond a tolerant range and is compensated. There are two cases for the comparison of the initial value of the common voltage and the value of the output common voltage. When the difference between the initial value of the common voltage and the value of the output common voltage is smaller than the preset threshold value, the first switch 240 controls the initiator 210 to work normally; and when the difference between the initial value of the common voltage and the value of the output common voltage is greater than or equal to the preset threshold value, the second switch 250 controls the compensator 220 to work to compensate the value of the common voltage.

In this embodiment, optionally, the initial memory 211 stores a first signal code corresponding to the initial value of the common voltage; the compensator 220 stores a compensating signal code of the common voltage; and the controller 230 includes: an ADC 260, configured to collect the value of the output common voltage of the initiator 210, and convert the value into a second signal code; and a master controller 270, configured to collect the first signal code of the initiator 210, and compare the second signal code with the first signal code, thereby deciding whether to control the compensator 220 to compensate the value of the common voltage or not.

In this solution, the initial memory 211 stores the first signal code corresponding to the initial value of the common voltage; the compensator 220 stores the compensating signal code of the common voltage; the ADC 260 collects the value of the output common voltage of the initiator 210, and converts the value into the second signal code; and at this moment, the master controller 270 compares the first signal code with the second signal code, and controls connection and disconnection of each of the switches according to the compassion result, thereby deciding whether to control the compensator 220 to compensate the value of the common voltage or not. During this process, by comparing the signal codes but not pure voltage values, the accuracy of data comparison is better guaranteed, and the intelligentization of the whole drive circuit 200 is also embodied.

In this embodiment, optionally, the ADC 260 includes: serial N resistors 261, where the resistors 261 are serially connected between a reference voltage and a low level to form N−1 partial voltages; an encoder 262, configured to encode a common voltage after voltage division; N−1 analog-digital conversion triodes 263, where first input ends of the N−1 analog-digital conversion triodes 263 are respectively connected to a plurality of the partial voltages, second input ends of the N−1 analog-digital conversion triodes 263 all are connected to the output common voltage of the initiator 210, and output ends of the N−1 analog-digital conversion triodes 263 are connected to the encoder 262; and the encoder 262 encodes the output common voltage of the initiator 210 into the second signal code and transmits the second signal code to the master controller 270.

Figure 5:
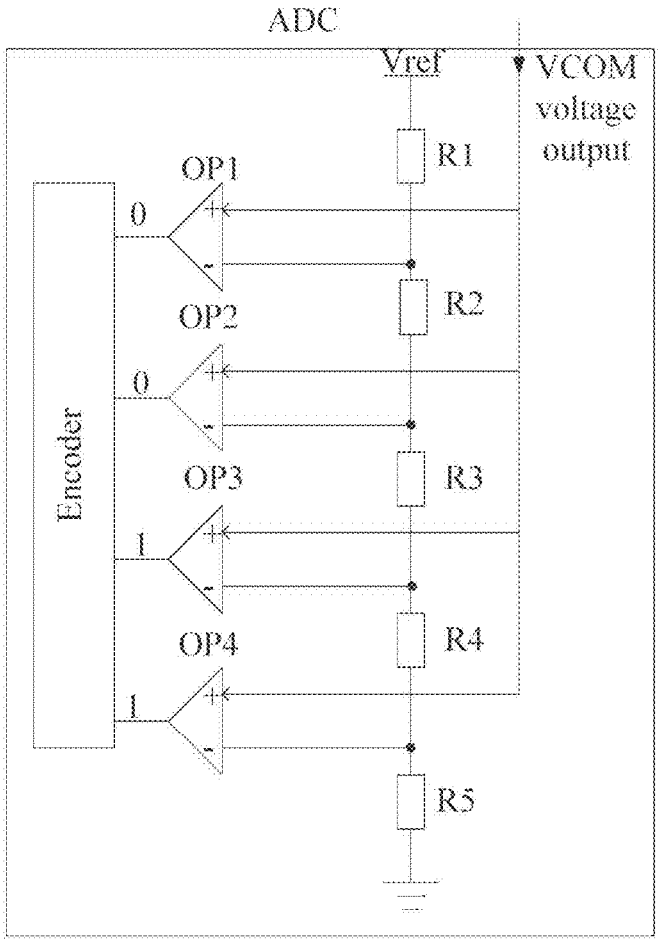
FIG. 5 is a structural schematic diagram of an ADC according to an embodiment of this application.

In this solution, as shown in FIG. 5, the ADC 260 is divided into three portions. A first portion includes the serial N resistors 261, where the resistors 261 are serially connected between the reference voltage and the low level to form the N−1 partial voltages. A second portion includes the encoder 262, configured to encode the common voltage after the voltage division. A third portion includes the N−1 analog-digital conversion triodes 263, where the first input ends of the N−1 analog-digital conversion triodes 263 are respectively connected to the plurality of the partial voltages, the second input ends of the N−1 analog-digital conversion triodes 263 all are connected to the output common voltage of the initiator 210, and the output ends of the N−1 analog-digital conversion triodes 263 are connected to the encoder 262; and the encoder 262 encodes the output common voltage of the initiator 210 into the second signal code and transmits the second signal code to the master controller 270. With the layer-by-layer division and the compact deployment, the accuracy of the data comparison is guaranteed.

In this embodiment, optionally, the master controller 270 includes: a decoder 271, coupled to an output end of the ADC 260, and configured to decode the second signal code transmitted from the ADC 260; a microcontroller 272, coupled to the decoder 271, and configured to perform operation on a decoded second signal code and the first signal code; and a controller 273, coupled to the microcontroller 272, and configured to decide, according to a comparison result of the microcontroller 272, whether to control the compensator 220 to compensate the value of the common voltage or not.

In this solution, the master controller 270 mainly functions to compare the first signal code and the second signal code, and to decide, via the comparison result, whether to enable the compensating signal code of the compensation memory 221 to compensate the common voltage or not; the decoder 271 decodes the second signal code transmitted from the encoder 262; the microcontroller 272 compares the decoded second signal code with the first signal code; and the controller 273 controls the connection and the disconnection of each of the switches according to the comparison result, and decides whether to compensate the common voltage or not. During this process, with the layer-by-layer division and the compact deployment, the accuracy of the data comparison is guaranteed, and the digitalization and the intelligentization of the whole drive circuit 200 are implemented.

In this embodiment, optionally, the operational circuit 280 includes: a digital-analog converter 281, configured to convert the first signal code transmitted from the initial memory 211 into an analog voltage; and an output current amplifier 282, configured to output the common voltage; an output end of the initial memory 211 is coupled to an input end of the digital-analog converter 281 via the first switch 240; an output end of the digital-analog converter 281 is coupled to an input end of the output current amplifier 282; an output end of the output current amplifier 282 is an output end of the initiator 210; and the compensator 220 includes: the compensation memory 221, configured to store the compensating signal code; the output end of the compensation memory 221 is coupled to the input end of the digital-analog converter 281 of the initiator 210 via the second switch 250; and the master controller 270 acquires the first signal code from the digital-analog converter 281 of the initiator 210.

In this solution, what we compared is the comparison of signal codes after voltage values are converted into digital signal codes; the digital-analog converter 281 converts the first signal code transmitted from the initial memory 211 into the analog voltage; the output current amplifier 282 outputs the common voltage; the compensation memory 221 stores the compensating signal code; and the master controller 270 acquires the first signal code from the digital-analog converter 281.

Figure 4:
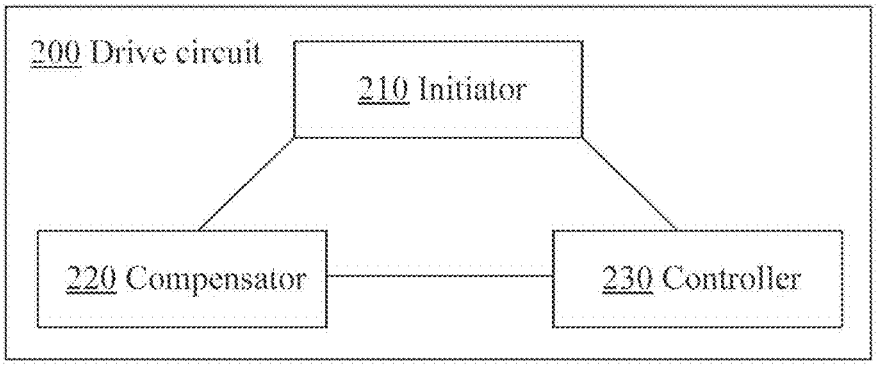
FIG. 4 is a structural schematic diagram of a control circuit board according to an embodiment of this application.

In this embodiment, optionally, as shown in FIG. 4, the drive circuit 200 includes a control circuit board 300; and the initiator 210, the compensator 220 and the controller 230 all are integrated in the control circuit board 300.

In this solution, by completely changing an internal architecture of the control circuit board 300, reversely detecting the output common voltage and then converting the output common voltage into the value for judgment, it may be very accurate and easy for digital control.

Figure 3:
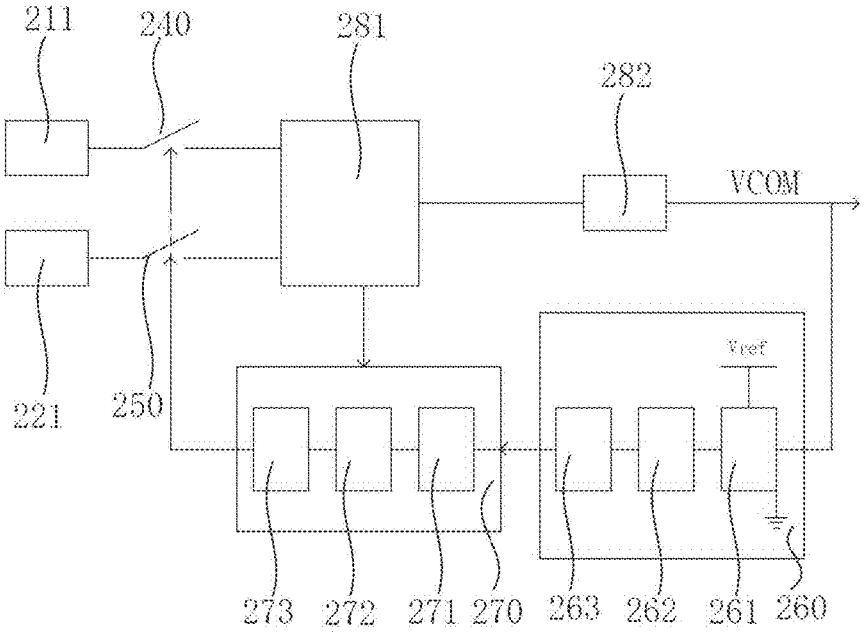
FIG. 3 is a schematic diagram of a drive circuit according to an embodiment of this application.

As another embodiment of this application, referring to FIG. 3, this application discloses a drive circuit 200; the drive circuit 200 includes: an initial memory 211, configured to store an initial value of a common voltage as well as a first signal code corresponding to the initial value of the common voltage; a first switch 240, connected with the initial memory 211 in a control manner, and configured to control, when a difference between the initial value of the common voltage and a value of an output common voltage is smaller than a preset threshold value, the initiator 210 to work normally; a digital-analog converter 281, configured to convert the first signal code transmitted from the initial memory 211 into an analog voltage; an output current amplifier 282, where an input end of the output current amplifier 282 is coupled to an output end of the digital-analog converter 281 and an output end of the output current amplifier 282 outputs the common voltage; a compensation memory 221, configured to store a compensating signal code; a second switch 250, connected with the compensation memory 221 in a control manner, and configured to control, when the difference between the initial value of the common voltage and the value of the output common voltage is greater than or equal to the preset threshold value, the compensation memory 221 to work to compensate the value of the common voltage; serial N resistors 261, where the N is equal to 5 for example, the resistors 261 are serially connected between a reference voltage and a low level to form N−1 partial voltages; an encoder 262, configured to encode a common voltage after voltage division; N−1 analog-digital conversion triodes 263, where first input ends of the N−1 analog-digital conversion triodes 263 are respectively connected to a plurality of the partial voltages, second input ends of the N−1 analog-digital conversion triodes 263 all are connected to the output common voltage of the initiator 210, and output ends of the N−1 analog-digital conversion triodes 263 are connected to the encoder 262, and the encoder 262 encodes the output common voltage of the initiator 210 into a second signal code and transmits the second signal code to a master controller 270; a decoder 271, coupled to an output end of an ADC 260, and configured to decode the second signal code transmitted from the ADC 260; a microcontroller 272, coupled to the decoder 271, and configured to perform operation on a decoded second signal code and the first signal code; and a controller 273, coupled to the microcontroller 272, and configured to decide, according to a comparison result of the microcontroller 272, whether to control the compensator 220 to compensate the value of the common voltage or not; and the drive circuit 200 further includes a control circuit board 300; and the initial memory 211, the first switch 240, the digital-analog converter 281, the output current amplifier 282, the compensation memory 221, the second switch 250, the serial N resistors 261, the encoder 262, the N−1 analog-digital conversion triodes 263, the decoder 271, the microcontroller 272 and the controller 273 all are integrated in the control circuit board 300.

Figure 6:
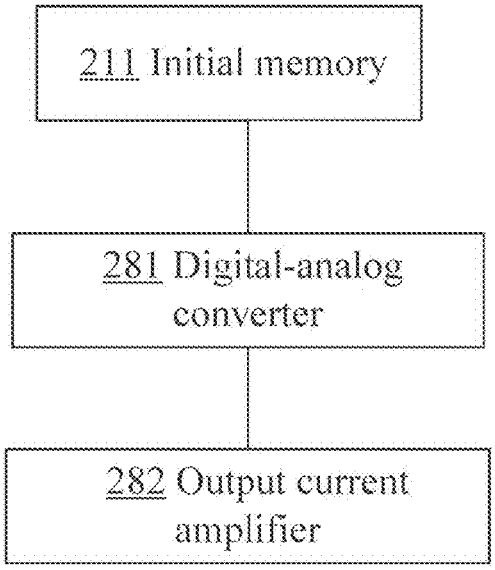
FIG. 6 is a schematic diagram of an original drive circuit according to an embodiment of this application.

In this solution, in the design architecture diagram of the drive circuit 200, the drive circuit 200 is generally provided with three components inside as shown in FIG. 6, i.e., the initial memory 211, the digital-analog converter 281 and the output current amplifier 282; and the signal code in the memory is transmitted to the digital-analog converter 281 and is converted into the analog voltage, and then is subject to current amplification via the output current amplifier 282, and at last is output. In this solution, the design point is that the compensator 221, the first switch, the second switch, the master controller 270 and the ADC 260 are newly increased. A specific working principle is as follows: an actual output common voltage of the drive circuit 200 is collected to the ADC 260, and then the actual voltage is converted into a digital code via the ADC. As shown in FIG. 5, five resistors are selected and four analog-digital conversion triodes are provided; a standard voltage (Vref) inside the ADC is divided by resistors R1-R5 and then partial voltages are sent to negative input ends of the analog-digital conversion triodes OP1-OP4, and a VCOM voltage is taken as a positive input end of each of OPs; and when the VCOM voltage is greater than a voltage at the negative input end of each of the OPs, each of the OPs outputs 1, or otherwise, outputs 0. In this way, different codes may be obtained via different VCOM voltages, so the analog-digital conversion is implemented. As shown in FIG. 5, a code converted by the VCOM voltage is 0011; then, the code is encoded by the encoder 262 and is transmitted to the master controller 270; and in the master controller 270, the code is first decoded by the decoder 271 and then is transmitted to the controller 273 for comparison. The controller 273 simultaneously reads an existing code in the digital-analog converter for comparison. It is assumed that a difference between two codes is beyond a set standard, i.e., the output voltage at this moment is considered to be low, the controller 273 disconnects the switch 1 and connects the switch 2 via the controller 273, i.e., the code stored in the compensating memory 221 is enabled and the stored code is the compensating code with a large value; and in other words, the voltage reduction due to load removal at a rear end is compensated via a code increasing manner. The solution is simple in design and is very suitable for an occasion in which a common voltage drifts. Where, a compensation standard may be set according to an actual condition; and with different sizes and resolutions of the panel, the common voltage is deviated in different degrees.

Figure 7:
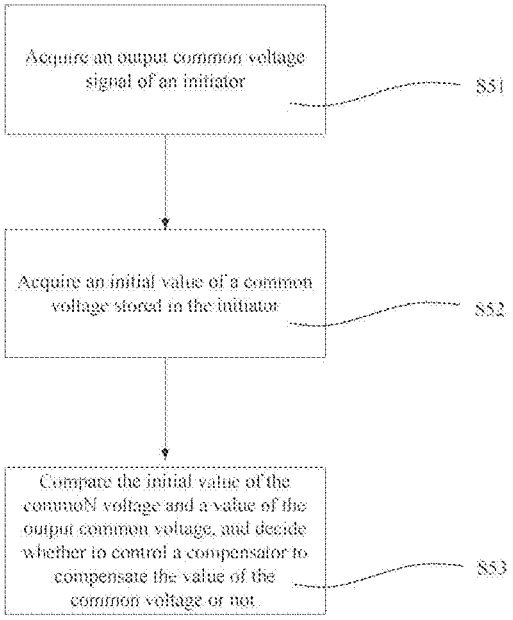
FIG. 7 is a schematic diagram of steps of a drive method according to an embodiment of this application.

As another embodiment of this application, referring to FIG. 7, this application discloses a drive method; the drive method corresponds to the above-mentioned drive circuit; the drive circuit includes an initiator and a compensator; and the drive method includes the following steps.

S51: Acquire an output common voltage signal of the initiator 210.

S52: Acquire an initial value of a common voltage stored in the initiator 210.

S53: Compare the initial value of the common voltage and a value of an output common voltage, thereby deciding whether to control the compensator 220 to compensate the value of the common voltage or not.

In this solution, the drive method of the drive circuit 200 mainly is to perform comparison and to compare acquired data. In this drive method, the output common voltage signal of the initiator 210 is acquired first; and then, the value of the acquired output common voltage is compared with the initial value of the common voltage, thereby deciding whether to compensate or not via a comparison result.

In this embodiment, optionally, a first signal code corresponding to the initial value of the common voltage is stored in the initiator 210, and a compensating signal code of the common voltage is stored in the compensator 220, 100521 where in the step of acquiring the output common voltage signal of the initiator 210, after the value of the output common voltage of the initiator 210 is acquired, the method further includes a step of converting the value into a second signal code; and in the step of comparing the initial value of the common voltage and the value of the output common voltage, the second signal code is compared with the first signal code, thereby deciding whether to control the compensator 220 to compensate the value of the common voltage or not.

In this solution, manners adopted for comparison are different. This comparison mainly is to convert an analog voltage into a digital code for comparison. With digital comparison, the data accuracy is higher and the result is more convincing. In the step of comparing the initial value of the common voltage and the value of the output common voltage, the second signal code is compared with the first signal code, thereby deciding whether to control the compensator 220 to compensate the value of the common voltage or not; and when a difference there between is beyond a set standard, the compensation is performed; and when the difference is not beyond the set standard, normal output is performed.

Figure 8:
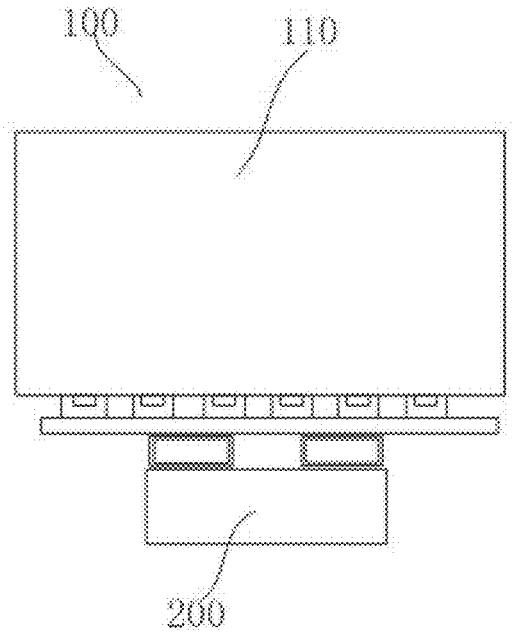
FIG. 8 is a schematic diagram of a display apparatus according to an embodiment of this application.

As another embodiment of this application, referring to FIG. 8, this application discloses a display apparatus 100, which includes a display panel 110; and the display panel 110 includes a first substrate 120 and a second substrate 130, where the second substrate 130 and the first substrate 120 are disposed oppositely; an array layer 121, formed on the first substrate 120; a common electrode 131, formed on the second substrate 130; and the above-mentioned drive circuit 200.

It is to be noted that, the limit on each step related in this solution is not considered as a limit to a sequential order of the steps on the premise of not affecting implementation of a specific solution. A step written in front may be executed ahead and may also be executed later, or even may also be executed simultaneously; and as long as this solution can be implemented, all should be considered as a scope of protection of this application.

In this application, the panel may be a Twisted Nematic (TN) panel, an In-Plane Switching (IPS) panel, a Multi-domain Vertical Alignment (VA) panel, and of source, may also be other types of appropriate panels.

The above are further detailed descriptions of this application in combination with specific optional implementation manners and should not be deemed as that the specific implementation of this application is only limited to these descriptions. A person of ordinary skill in the art to which this application belongs may further make a plurality of simple deviations or replacements without departing from the concept of this application and all should be considered as the scope of protection of this application.

What is claimed is:

1. A drive circuit, comprising:

an initiator, configured to output a common voltage;

a compensator, coupled to the initiator; and a controller, the initiator comprises:

an initial memory, configured to store an initial value of the common voltage; and an operational circuit, configured to convert the initial value of the common voltage into an output common voltage to output; and the controller collects the initial value of the common voltage of the initiator and a value of the output common voltage, and compares the initial value of the common voltage and the value of the output common voltage, thereby deciding whether to control the compensator to compensate the value of the common voltage or not;

wherein the controller comprises:

a first switch, connected with the initial memory in a control manner, and configured to control, when a difference between the initial value of the common voltage and the value of the output common voltage is smaller than a preset threshold value, the initiator to work normally; and a second switch, connected with the compensator in a control manner, and configured to control, when the difference between the initial value of the common voltage and the value of the output common voltage is greater than or equal to the preset threshold value, the compensator to work to compensate the value of the common voltage;

wherein the initial memory stores a first signal code corresponding to the initial value of the common voltage; and the compensator stores a compensating signal code of the common voltage.

2. The drive circuit according to claim 1, wherein the controller further comprises:

an Analog-Digital Converter, configured to collect the value of the output common voltage of the initiator, and convert the value into a second signal code; and a master controller, configured to collect the first signal code of the initiator, and compare the second signal code with the first signal code, thereby deciding whether to control the compensator to compensate the value of the common voltage or not.

3. The drive circuit according to claim 2, wherein the Analog-Digital Converter comprises:

serial N resistors, wherein the resistors are serially connected between a reference voltage and a low level to form N−1 partial voltages;

an encoder, configured to encode a common voltage after voltage division; and

N−1 analog-digital conversion triodes, wherein first input ends of the N−1 analog-digital conversion triodes are respectively connected to a plurality of the partial voltages, second input ends of the N−1 analog-digital conversion triodes all are connected to the output common voltage of the initiator, and output ends of the N−1 analog-digital conversion triodes are connected to the encoder; and the encoder encodes the output common voltage of the initiator into the second signal code and transmits the second signal code to the master controller.

4. The drive circuit according to claim 3, wherein the master controller comprises:

a decoder, coupled to an output end of the Analog-Digital Converter, and configured to decode the second signal code transmitted from the Analog-Digital Converter;

a microcontroller, coupled to the decoder, and configured to perform operation on a decoded second signal code and the first signal code; and a controller, coupled to the microcontroller, and configured to decide, according to a comparison result of the microcontroller, whether to control the compensator to compensate the value of the common voltage or not.

5. The drive circuit according to claim 4, wherein the operational circuit comprises:

a digital-analog converter, configured to convert the first signal code transmitted from the initial memory into an analog voltage; and an output current amplifier, configured to output the common voltage; and an output end of the initial memory is coupled to an input end of the digital-analog converter via the first switch; an output end of the digital-analog converter is coupled to an input end of the output current amplifier; and an output end of the output current amplifier is an output end of the initiator.

6. The drive circuit according to claim 5, wherein the compensator comprises:

a compensation memory, configured to store the compensating signal code;

the output end of the compensation memory is coupled to the input end of the digital-analog converter of the initiator via the second switch; and the master controller acquires the first signal code from the digital-analog converter of the initiator.

7. The drive circuit according to claim 6, wherein the drive circuit comprises the control circuit board; and the initiator, the compensator and the controller all are integrated in the control circuit board.

8. The drive circuit according to claim 1, wherein the drive circuit comprises a control circuit board; and the initiator, the compensator and the controller all are integrated in the control circuit board.

9. A drive method for application in a drive circuit of a display panel, the drive circuit comprising an initiator configured to output a common voltage, a compensator coupled to the initiator, and a controller, wherein the initiator comprises an initial memory configured to store an initial value of the common voltage and an operational circuit configured to convert the initial value of the common voltage into an output common voltage to output, wherein the drive method comprises:

acquiring an output common voltage signal of the initiator;

acquiring the initial value of a common voltage stored in the initiator memory; and comparing the initial value of the common voltage with a value of an output common voltage; and controlling the compensator to compensate the value of the common voltage when a difference between the initial value of the common voltage and the value of the output common voltage is greater than or equal to a preset threshold value.

10. The drive method according to claim 9, wherein a first signal code corresponding to the initial value of the common voltage is stored in the initiator; and a compensating signal code of the common voltage is stored in the compensator.

11. The drive method according to claim 10, wherein in the step of acquiring the output common voltage signal of the initiator, after the value of the output common voltage of the initiator is acquired, the method further comprises a step of converting the value into a second signal code; and in the step of comparing the initial value of the common voltage and the value of the output common voltage, the second signal code is compared with the first signal code, thereby deciding whether to control the compensator to compensate the value of the common voltage or not.

12. A display apparatus, comprising a display panel, the display panel comprising:

a first substrate:

a second substrate, disposed opposite to the first substrate;

an array layer, formed on the first substrate:

a common electrode, formed on the second substrate; and a drive circuit, configured to drive the display panel, wherein the drive circuit comprises:

an initiator, configured to output a common voltage;

a compensator, coupled to the initiator; and a controller, the initiator comprises:

an initial memory, configured to store an initial value of the common voltage; and an operational circuit, configured to convert the initial value of the common voltage into an output common voltage to output; and the controller collects the initial value of the common voltage of the initiator and a value of the output common voltage, and compares the initial value of the common voltage and the value of the output common voltage, thereby deciding whether to control the compensator to compensate the value of the common voltage or not;

wherein the controller comprises:

a first switch, connected with the initial memory in a control manner, and configured to control, when a difference between the initial value of the common voltage and the value of the output common voltage is smaller than a preset threshold value, the initiator to work normally; and a second switch, connected with the compensator in a control manner, and configured to control, when the difference between the initial value of the common voltage and the value of the output common voltage is greater than or equal to the preset threshold value, the compensator to work to compensate the value of the common voltage, wherein the initial memory stores a first signal code corresponding to the initial value of the common voltage, and the compensator stores a compensating signal code of the common voltage.

13. The display apparatus according to claim 12, wherein the controller further comprises:

an Analog-Digital Converter, configured to collect the value of the output common voltage of the initiator, and convert the value into a second signal code; and a master controller, configured to collect the first signal code of the initiator, and compare the second signal code with the first signal code, thereby deciding whether to control the compensator to compensate the value of the common voltage or not.

14. The display apparatus according to claim 13, wherein the Analog-Digital Converter comprises:

serial N resistors, wherein the resistors are serially connected between a reference voltage and a low level to form N−1 partial voltages;

an encoder, configured to encode a common voltage after voltage division; and

N−1 analog-digital conversion triodes, wherein first input ends of the N−1 analog-digital conversion triodes are respectively connected to a plurality of the partial voltages, second input ends of the N−1 analog-digital conversion triodes all are connected to the output common voltage of the initiator, and output ends of the N−1 analog-digital conversion triodes are connected to the encoder; and the encoder encodes the output common voltage of the initiator into the second signal code and transmits the second signal code to the master controller.

15. The display apparatus according to claim 14, wherein the master controller comprises:

a decoder, coupled to an output end of the Analog-Digital Converter, and configured to decode the second signal code transmitted from the Analog-Digital Converter;

a microcontroller, coupled to the decoder, and configured to perform operation on a decoded second signal code and the first signal code; and a controller, coupled to the microcontroller, and configured to decide, according to a comparison result of the microcontroller, whether to control the compensator to compensate the value of the common voltage or not.

16. The display apparatus according to claim 15, wherein the operational circuit comprises:

a digital-analog converter, configured to convert the first signal code transmitted from the initial memory into an analog voltage; and an output current amplifier, configured to output the common voltage;

an output end of the initial memory is coupled to an input end of the digital-analog converter via the first switch; an output end of the digital-analog converter is coupled to an input end of the output current amplifier; and an output end of the output current amplifier is an output end of the initiator;

the compensator comprises:

a compensation memory, configured to store the compensating signal code;

the output end of the compensation memory is coupled to the input end of the digital-analog converter of the initiator via the second switch; and the master controller acquires the first signal code from the digital-analog converter of the initiator.

17. The display apparatus according to claim 16, wherein the drive circuit comprises a control circuit board; and the initiator, the compensator and the controller all are integrated in the control circuit board.

* * * * *